US009470418B2

(12) United States Patent
Bacon

(10) Patent No.: US 9,470,418 B2
(45) Date of Patent: Oct. 18, 2016

(54) GAS ASSIST ASSEMBLY FOR USE WITH A WASTE GAS FLARE STACK

(71) Applicant: David Bacon, Bastrop, TX (US)

(72) Inventor: David Bacon, Bastrop, TX (US)

( * ) Notice: Subject to any disclaimer, the term of this patent is extended or adjusted under 35 U.S.C. 154(b) by 279 days.

(21) Appl. No.: 14/296,883

(22) Filed: Jun. 5, 2014

(65) Prior Publication Data

US 2015/0354815 A1 Dec. 10, 2015

(51) Int. Cl.
*F23G 7/06* (2006.01)
*F23G 7/08* (2006.01)

(52) U.S. Cl.
CPC ..... *F23G 7/085* (2013.01)

(58) Field of Classification Search
CPC ..... F23G 7/085; F23G 7/08
USPC ..... 431/202, 114, 190
See application file for complete search history.

(56) References Cited

U.S. PATENT DOCUMENTS 5,749,719 A * 5/1998 Rajewski ..... F23G 7/085 431/114
2006/0121399 A1* 6/2006 Mashhour ..... F23L 17/16 431/202

* cited by examiner

*Primary Examiner* — Avinash Savani
(74) *Attorney, Agent, or Firm* — Bushman Werner, P.C.

(57) ABSTRACT

A gas assist flare tip for enhancing smokeless combustion of a flare gas. The assist tip which has a shroud positioned on a flare stack, the shroud having an outer annular portion and an inner tubular portion which fits over the riser. There is an annular plenum which is partially formed by the tubular portion and the outer portion and has an annular vent proximate the open end of the riser. There is at least one air jet eductor having a discharge outlet opening into the plenum.

25 Claims, 5 Drawing Sheets

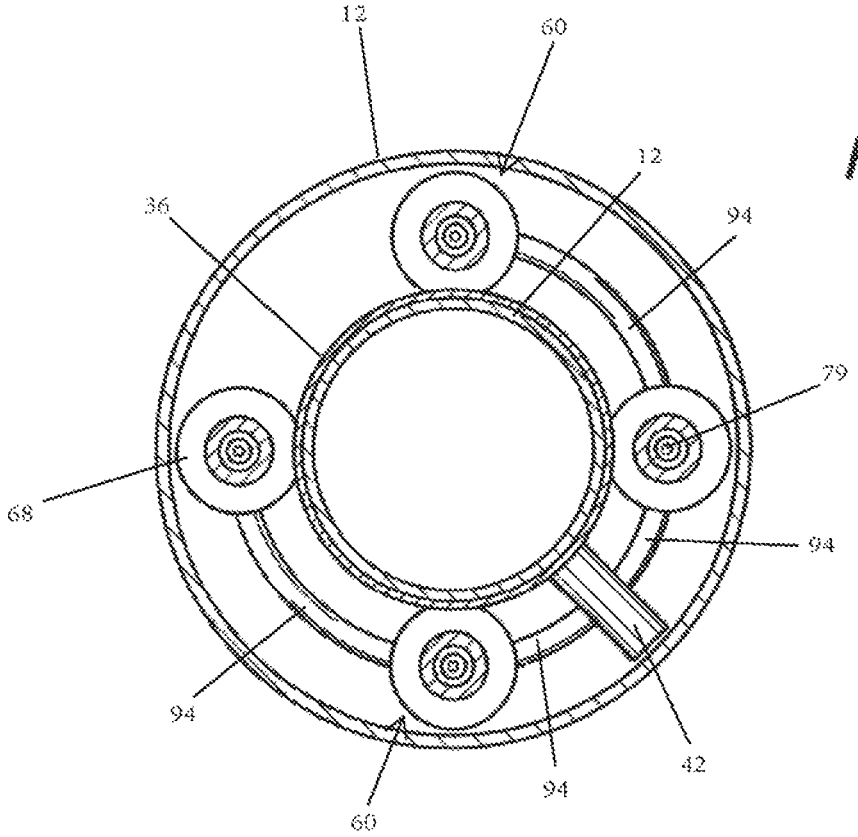
FIG. 3
FIG. 7
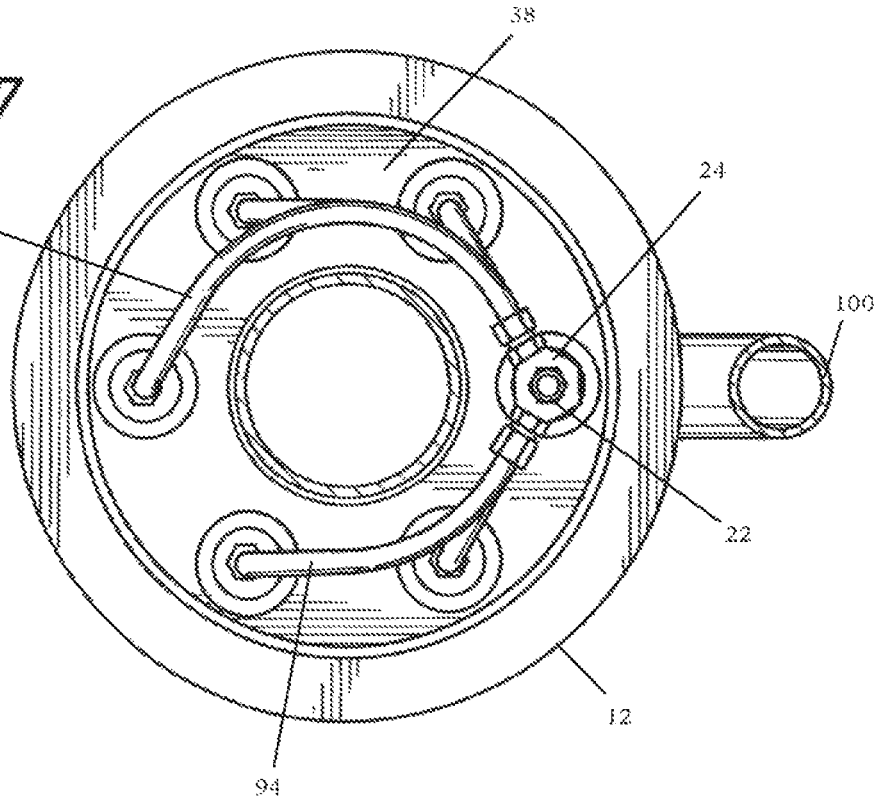

GAS ASSIST ASSEMBLY FOR USE WITH A WASTE GAS FLARE STACK

BACKGROUND OF THE INVENTION

1. Field of the Invention

The present invention relates to waste gas flares and, more particularly, to a gas assist assembly for use with such flares.

2. Description of the Prior Art

Flaring is a high temperature oxidation process used to burn combustible components, mostly hydrocarbons, of waste gases from industrial operations. Natural gas, propane, ethylene, propylene, butadiene and butane constitute over 95% of the waste gases flared. Flares are used extensively to dispose of (1) purged and waste products from refineries, (2) unrecoverable gases emerging from oil and gas well instillation, (3) vented gases from blast furnaces, (4) unused gases from coke ovens, and (5) gaseous wastes from chemical industries.

There are generally two types of flares, elevated and ground flares. The present invention is particularly applicable to use with elevated flares. Elevated flares, comprise a flare riser, which can extend from a few feet to several hundred feet above the ground to a flare tip from which the waste gases exit. A waste gas stream is fed through the riser and is combusted at the tip. A typical elevated flare system consists of (1) a gas collection header and piping for collecting gases from processing units, (2) a knockout drum (disentrainment drum) to remove and store condensables, entrained liquids and particulates, (3) a single- or multiple-burner unit, (4) a flare stack riser, and (5) an igniter e.g., a gas pilot or an electronic igniter, to ignite the mixture of waste gas and air, and, if required, (6) a provision for external momentum force e.g., a motive gas such as e.g., steam injection, forced air, or some other gas for smokeless flaring.

Due to process and/or regulatory considerations, various other gases are sometimes added to the released waste gas stream. Examples of other gases that are added to the released gas stream include purge gas (for example, natural gas or nitrogen) and enrichment fuel gas (for example natural gas or propane). The gas stream that arrives at the inlet of the flare tip is referred to as "vent gas" regardless of whether it consists of only the released waste gas or the released waste gas together with other gases e.g., purge gas, motive gas, etc. that have been added thereto. Typically, the vent gas together with all other gases and vapors present in the atmosphere immediately downstream of the flare tip, not including air, but including steam or other assist gas added at the flare tip and fuel gas discharged from the pilot or pilots of the flare assembly, is referred to as "flare gas".

Purge gas is often added to the released waste gas stream (or otherwise to the flare assembly if a waste gas stream is not being released by the facility at the time) in order to maintain a positive gas flow through the flare assembly and prevent air and possibly other gases from back flowing therein.

Most gas flares are required to operate in a relatively smokeless manner. This is generally achieved by making sure that the vent gas is admixed with a sufficient amount of air in a relatively short period of time to sufficiently oxidize the soot particles formed in the flame. In applications where the gas pressure is low, the momentum of the vent gas stream alone may not be sufficient to provide smokeless operation. In such applications, it is necessary to add an assist medium (gas) to achieve smokeless operation. The assist medium can be used to provide the necessary motive force to entrain ambient air from around the flare apparatus. Examples of useful assist media include steam, air, natural gas, propane, etc. Many factors, including local energy costs and availability, must be taken into account in selecting a smoke suppressing medium (gas assist).

A common assist medium for adding momentum to low-pressure gases is air which is typically injected through one or more groups of nozzles that are associated with i.e., adjacent the flare tip. In using gas assist, the assist assembly has jets which eject the assist gas into the discharge vent gas with high levels of turbulence.

For cost savings it is desirable to have a flare gas assist assembly which minimizes the amount of gas employed to generate the assist gas while at the same time enhancing the formation of a smokeless flare.

SUMMARY OF THE INVENTION

In one aspect the present invention provides an apparatus for enhancing smokeless combustion of a waste gas issuing from the riser of a flare stack.

In another aspect, the present invention provides a gas assist flare tip apparatus in which assist gas is introduced into the flare flame at a high velocity.

In still another aspect the present invention provides a gas assist assembly for use with a flare stack which minimizes the amount of assist gas required to ensure a clean, smokeless burn.

In still another aspect, the present invention provides a method for enhancing smokeless operation of a flare while minimizing the amount of assist gas required.

In still a further aspect, the present invention provides a gas assist flare tip apparatus for use in assisting the combustion of waste gases from both high pressure and low pressure sources.

These and further features and advantages of the present invention will become apparent from the following detailed description, wherein reference is made to the figures in the accompanying drawings.

BRIEF DESCRIPTION OF THE DRAWINGS

FIG. 3 is a cross sectional view taken along the lines 3-3 of FIG. 2.

FIG. 6 is a view similar to FIG. 2 showing yet another embodiment of the apparatus of the present invention and FIG. 7 is a plan view taken along the lines 7-7 of FIG. 6.

DETAILED DESCRIPTION OF PREFERRED EMBODIMENTS

As used herein, the term "eductor" or "eductor assembly" means any device or assembly which is driven by a pressurized gas i.e., a motive gas, and which can aspirate large volumes of air into the resulting assist gas relative to the amount of motive gas employed.

Figure 1:
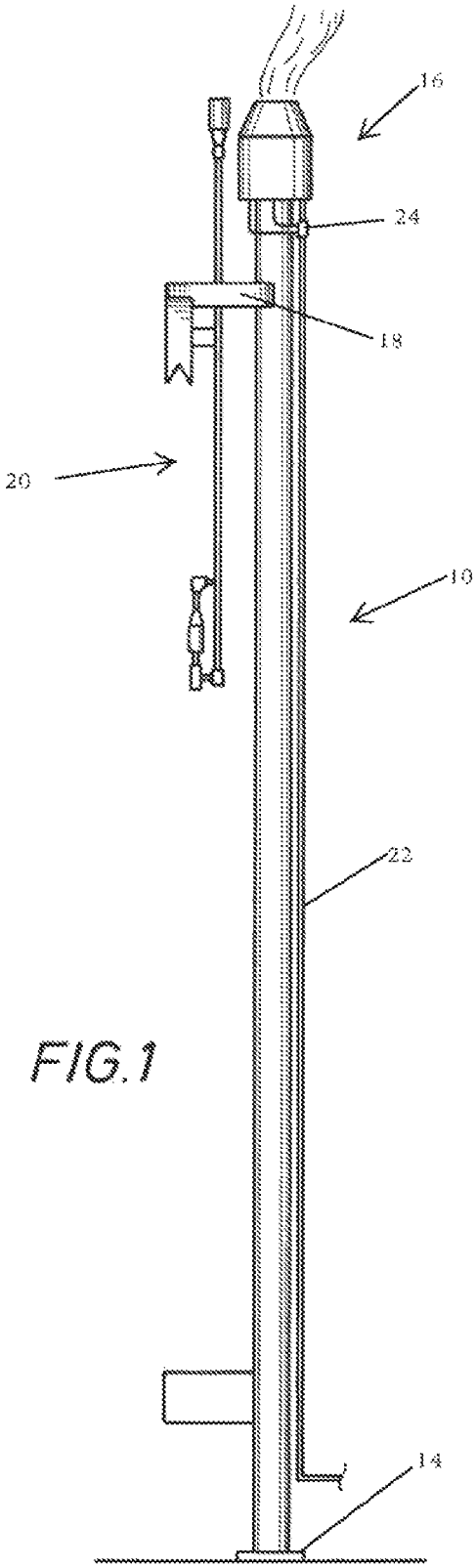
FIG. 1 is an elevational view showing a typical elevated flare stack.

Referring first to FIG. 1, there is shown a typical flare stack 10 comprising a riser 12, mounted on a suitable base 14 in a well known manner. Although not shown, it will be understood that there is a source of waste gas introduced into riser 12 again in a well known manner. Disposed adjacent the open end of riser 12 of flare stack 10 is a gas assist flare tip apparatus shown generally as 16 and described more fully hereafter. Mounted on a bracket 18 secured to riser 12 is an igniter assembly shown generally as 20 which can be one of many types well known to those in the art. For example it could be a spark ignited pilot, a constant flame pilot etc. It will be understood that, while not shown, a suitable fuel gas, line and/or necessary utility wires would be connected to igniter assembly 20. A motive gas feed line 22 attached to a suitable source of pressurized, motive gas (not shown) is connected to a manifold 24 forming part of flare gas tip assembly 16 and described more fully hereafter.

Figure 2:
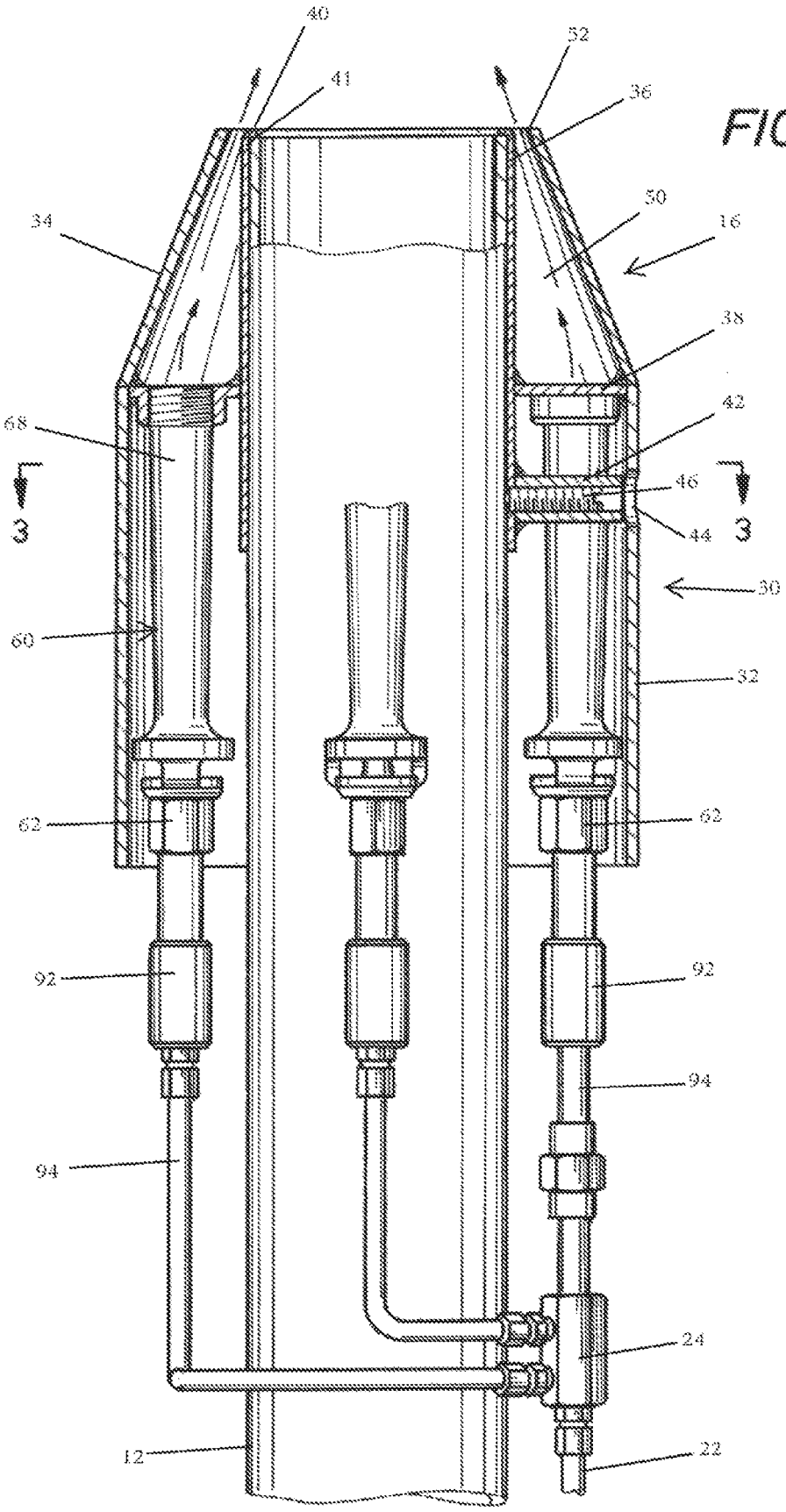
FIG. 2 is an elevational view, partly in section, showing one embodiment of the gas assist flare tip apparatus according to the present invention.

Referring now to FIG. 2 there is shown the details of one embodiment of the flare tip apparatus of the present invention. Apparatus 16 includes an annular shroud shown generally as 30, shroud 30 having an upper frustoconical portion 34 and a lower, generally cylindrical skirt portion 32. Shroud 30 further includes a generally centrally located tubular portion 36 which terminates at its upper end in a radially inwardly extending lip 40 which engages the upper end 41 of riser 12 when tubular portion 38 is slid over the upper open end of riser 12 to maintain apparatus 16 in the position shown in FIG. 2. As shown, the ID of tubular portion 36 is slightly greater than the OD of riser 12 to allow apparatus 16 to be fitted over the open end of riser 12. Tubular portion 36 is connected to frustoconical portion 34 by an annular plate 38 disposed between and welded to portion 34 and 36. There is an internally threaded tube 42 which is welded to tubular portion 36, tube 42 being in open communication with an opening 44 extending through skirt portion 32 of shroud 30. As shown, received in threaded tube 44 is a set screw 46 which can be urged toward and engage the OD of riser 12 to bite into riser 12 and securely hold apparatus 16 onto riser 12 if desired, a threaded bolt could be used rather than a set screw as shown.

An annular plenum 50 is formed in the space bounded by tubular member 36, frustoconical portion 34 and annular plate 38 of shroud 30, plenum 50 being generally triangularly shaped when viewed in cross-section. Plenum 52 terminates at its upper most end in an annular vent or gap 52 which provides a constricted flow of gas out of plenum 50 and directs it in an annular converging pattern generally radially inwardly toward a flare flame (not shown) issuing from riser 12 which ideally is located just slightly above the open end of riser 12.

The area of vent 52 can vary, provided it acts to constrict gas flow out of plenum 50 and thereby increases its velocity as it exits gap 52. This ensures that gases in plenum 50 issuing through vent 52 not only thoroughly mix with the vent gases out of riser 12 but also ensures that the gases are introduced at 360° into the issuing vent gases and hence the flame. This help ensures smokeless operation as this flow induces turbulence in the flame enhancing the combustion of soot particles thereby leaving no visible smoke.

Figure 4:
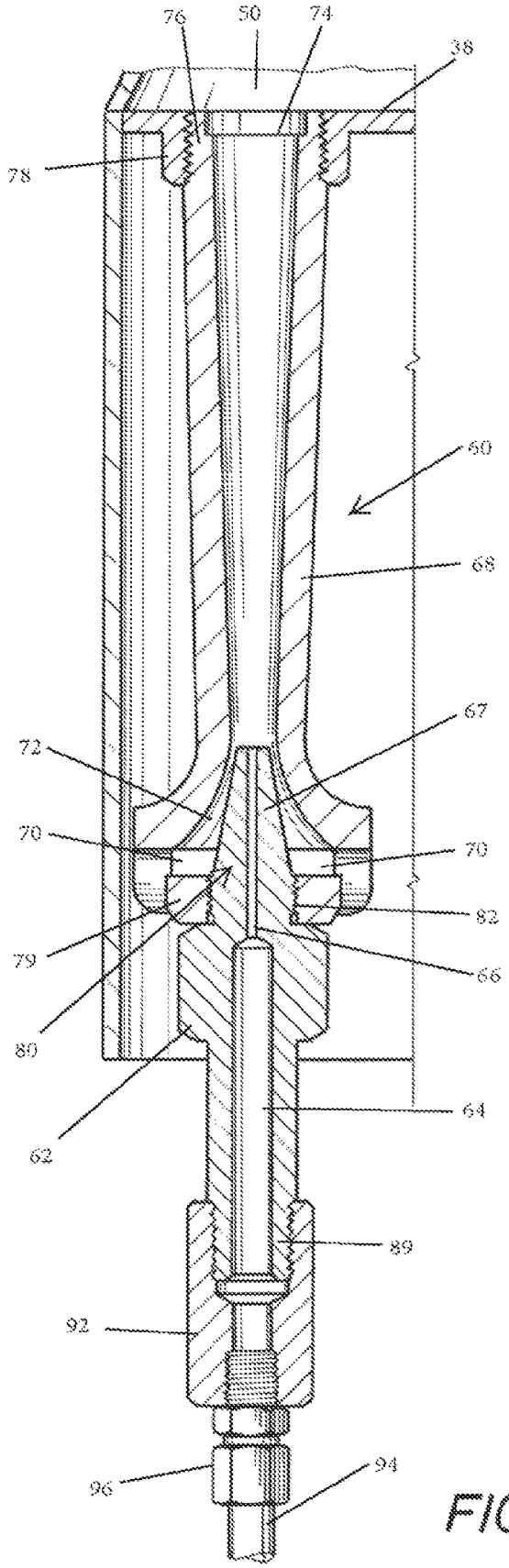
FIG. 4 is an elevational view, partly in section, of one of the air jet eductors used in the gas assist flare tip apparatus of the present invention.

As best seen in FIGS. 2, 3 and 4, there are a plurality of air jet educators, shown generally as 60, at least partially positioned in shroud 30. With particular reference to FIG. 4, each of the eductors 60 are comprised of a venturi type system and include a venturi body 62 having an inlet 64 in communication with a constricted flow bore 66 to form a motive nozzle 67, nozzle 67 opening into a venturi diffuser tube 68. Body 62 further includes suction inlets 70 which open into the throat 72 of the diffuser tube 68. Diffuser tube 68 has a mouth 74 which opens into plenum 50. Diffuser tube 68 is provided with an externally threaded end 76 which is threadedly received in a threaded socket 78 extending downwardly from plate 38.

Diffuser tube 68 has a lower end 79 forming a threaded socket 80 whereby an externally threaded portion 82 on the portion of body 62 forming motive nozzle 67 can be connected to diffuser tube 68.

Body 62 also has a threaded end 89 which is threadedly received in a coupling 92 to which is attached a gas line 94 via a fitting 96. As can be seen with reference to FIG. 2, gas line 94 is in turn connected to manifold 24 connected to feed gas line 22 as described above. Manifold 24 is multi-ported, there being a plurality of outlets for threadedly receiving a plurality of gas lines 94, respectively.

There are instances where the disposal of both sources of high pressure and low pressure waste gas is necessary. For example, at a well site, be it on shore or offshore, the high pressure natural gas which cannot be recovered is flared. However, in the crude oil tank batteries, gas escaping from the crude oil, which is generally under lower pressure, must also be flared or otherwise disposed of since it cannot be released to atmosphere. It is generally not possible to combine the low pressure waste gas with the high pressure waste gas since there is the possibility that the high pressure gas stream could pressure up the source of the low pressure gas i.e., the oil tank batteries, causing potential hazards. The embodiments of FIGS. 5 and 6, described hereafter, address this problem.

Figure 5:
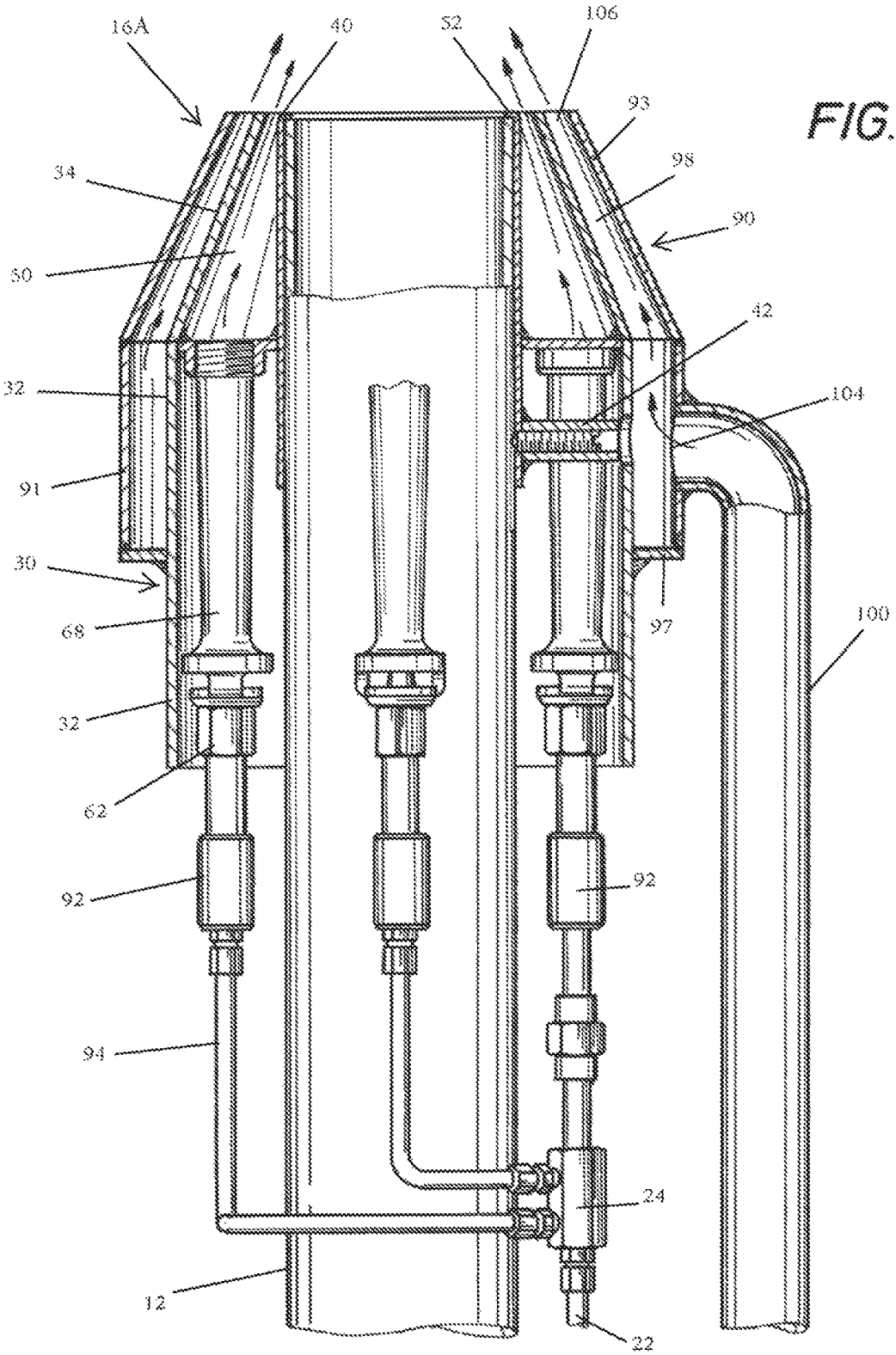
FIG. 5 is a view similar to FIG. 2 showing another embodiment of the apparatus of the present invention.

Turning then to FIG. 5, the flare gas assist tip apparatus shown generally as 16A is substantially as shown in FIG. 2 with the exception that the apparatus also includes structure for handling low pressure waste gas. To this end there is a second shroud shown generally as 90 in surrounding relationship to first shroud 30 and having an upper frustoconical portion 93 and a lower, cylindrical skirt portion 91. Shroud 90 is affixed to shroud 30 via an annular plate 97 which is welded to the cylindrical skirt portion 32 of shroud 30 and the cylindrical skirt portion 91 of shroud 90. There is thus formed a second plenum having an upper portion 98 which is generally concentric with plenum 50. A pipe 100 connected to the source of low pressure waste gas is connected to skirt 91 of shroud 90 which has an opening 104 therein such that low pressure waste gas flowing through pipe 100 is introduced into plenum 98. The upper ends of frustoconical portions 34 of shroud 30 and 93 of shroud 90 cooperate to form an annular vent 106 through which the low pressure waste gas exits in a 360° pattern directed generally radially inwardly towards the flame issuing from the open end of riser 12. Although no motive gas is introduced into plenum 98 as in the case with plenum 50, the high velocity flow of gas out of annular vent 40 exerts an aspiration of gas exiting through annular vent 106 thereby assisting in forcing the low pressure waste gas in plenum 98 into the flame for combustion. This is an important feature of the present invention since, as noted above, the disposal of both the low pressure and high pressure waste gases is important. With this embodiment of the present invention, there is no need for additional motive gas to assist the introduction of the low pressure waste gas exiting annular vent 106 and force it into the flame above the open end of riser 12. Again this converging, annular flow pattern of both high pressure and low pressure waste gases creates turbulence in the flame maximizing the combustion of all soot particles in the flame.

Figure 6:
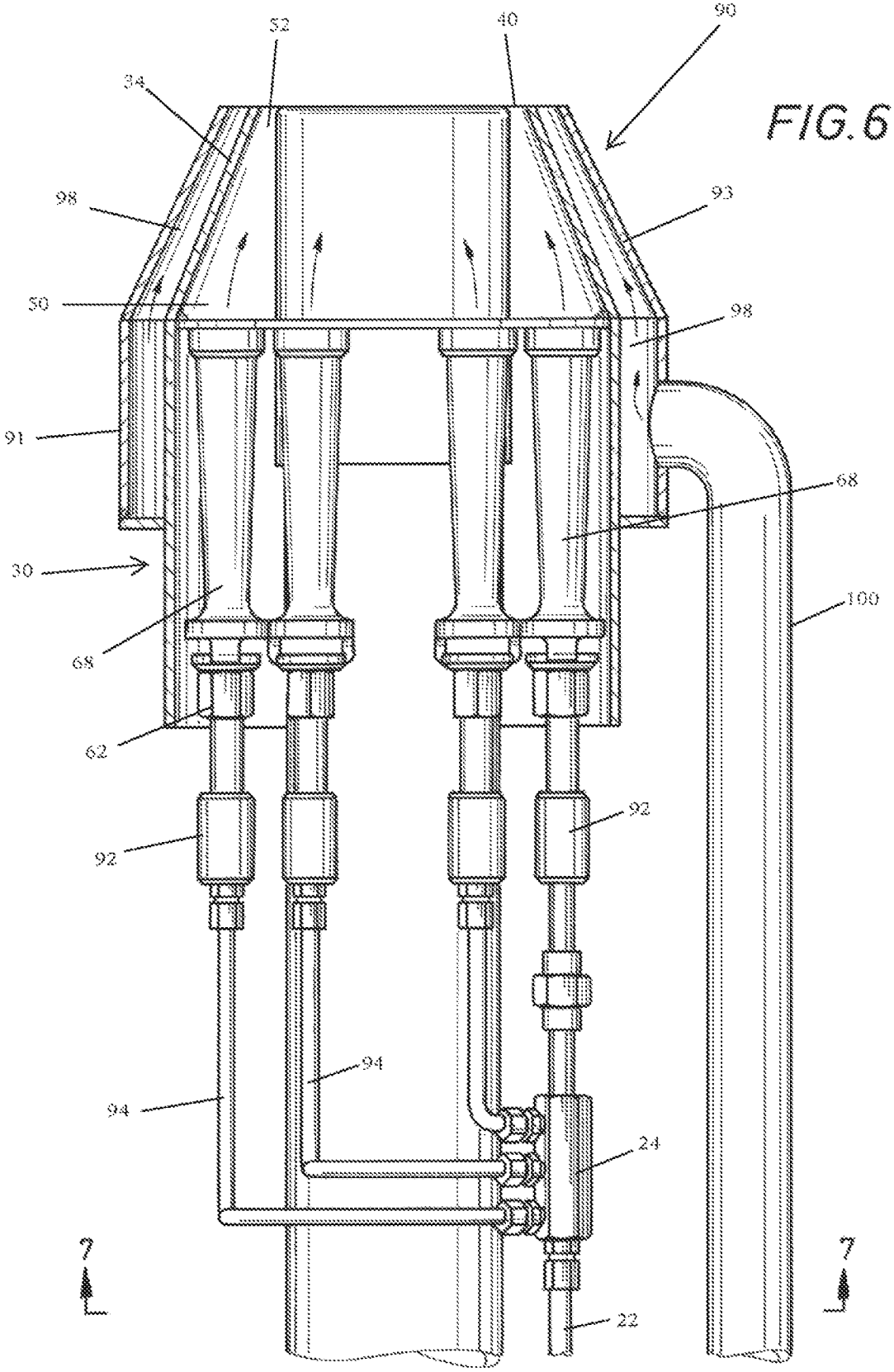

Referring now to FIG. 6 there is shown another embodiment of the present invention. FIG. 6 differs from the embodiment shown in FIG. 5 only in that in FIG. 5 four eductors are used whereas in the embodiment shown in FIG. 6, six eductors are used. This can best be seen with reference to FIG. 7.

The principle of operation of the gas assist flare tip apparatus of the present invention can best be understood with reference to FIGS. 2 and 4. A source of motive gas which can be air, natural gas or any other number of gases under pressure is introduced via motive gas line 22 into manifold 24 and line 94 into the inlet 64 of venturi body 62. In inlet 64 the gas is at a pressure of from about 30 to about 120 psi. As the motive gas flows through the constricted bore 66 of the portion of body 62 forming motive nozzle 67, there is a pressure decrease but a velocity increase. The high velocity motive gas exiting motive nozzle 67 creates a vacuum or suction in the throat 72 which draws in or aspirates air through inlets 70. At this point, the motive gas and the air are completely mixed to form the assist gas which now passes into the diffuser tubes 68 where the gas velocity is now converted to pressure sufficient to meet the needed discharge pressure into plenum 50. The pressure of the assist gas in plenum 50 is then converted to velocity as it is forced to exit plenum 50 through constricted flow annular vent 52. In effect, the overall operation of the system can be considered to provide a first stage where motive gas pressure is converted into motive gas, velocity which is used to draw in air, the combined motive gas and air forming the assist gas. The pressure of the assist gas is then converted into velocity in a second stage (the plenum) to provide a high flow rate at a high velocity out of the annular vent. This has tremendous advantage in that the amount of motive gas needed to induce smokeless combustion in the flare flame is greatly reduced. In this regard, many prior art assist gas assemblies employ numerous nozzles surrounding the riser outlet in different patterns and use high assist gas flow rates to the nozzle in an attempt to cause sufficient turbulence in the flame and enhance smokeless combustion. It is estimated that using the apparatus and method of the present invention, the motive gas used is approximately half the amount of assist gas used in prior art systems to provide ample assist gas for a given sized riser.

It will be apparent that the motive gas pressure and flow rates can vary but that generally a minimum motive gas pressure of 40 psi at the inlet of the venturi assembly is employed. With respect to the area of the annular vent 52 out of the plenum 50, it has been found that the system functions well when that area is from about 5 to about 10 times the cumulative cross sectional areas of the constricted bores 80 in the motive nozzles 67. It will be understood however that this relationship can be varied to effectively tune the system so that maximum smokeless flaring is achieved.

According to the method of the present invention, a motive gas of pressure $P_1$ and velocity $V_1$ is introduced in to the motive nozzle of a venturi body to produce a discharge gas from the motive nozzle at a velocity of $V_2$ where $V_2$ is greater than $V_1$ and a pressure of $P_2$ which is less than the pressure $P_1$. The exiting gas having pressure $P_2$ and velocity $V_2$ is then introduced into a plenum having a constricted annular vent, the gas in the plenum being under a pressure $P_3$ about or slightly less than $P_2$. The gas in the plenum is then vented through an annular vent and exits at a velocity $V_3$ which is between velocity $V_1$ and velocity $V_2$. Further, according to the method of the present invention the high velocity gas exiting the motive nozzle draws in a large volume of air which passes with the motive gas through the venturi diffuser tubes into the plenum.

The unique construction of the apparatus of the present invention, as noted above, uses less motive gas but yet produces large volumes of assist gas at higher velocities than is accomplished by prior art systems. In this regard, the eductor assembly of the present invention which employs a venturi allows a relatively small amount of motive gas to aspirate in a high volume of air to produce an assist gas comprised of motive gas and air which is directed into the flare at high velocities and high flow rates. In effect, the eductor of the present invention acts as a multiplier in the sense that for a given amount of motive gas employed the amount of assist gas produced is many times greater.

Using the assist apparatus of the present invention in an embodiment where there are six eductors as shown for example in FIG. 6 or 7, and wherein the cross-sectional area of each motive nozzle bore is from about 0.5 to about 1.25 $in^2$ it has been found that the exit velocity of the assist gas from the annular vent into the flame is approximately 118 ft/sec at a flow rate of 270 SCFM using a motive gas feed to the inlet of the venturi body having a pressure of 40 psi. If the pressure of the motive gas at the inlet of the venturi body is raised to 100 psi, then the exit velocity increases to 180 feet/second at a flow rate of 420 SCFM.

While the apparatus has been described above with respect to the plenum being formed at least partially by a frustoconical portion, the plenum being generally triangular when viewed in transverse cross-section, it is to be understood that it is not so limited. A plenum having many cross-sectional shapes, including generally rectangular, can be used provided that there is an annular vent at the upper end of the plenum, regardless of its cross-sectional shape, which is proximate the open end of the riser. Such a design is less advantageous since the high velocity assist gas issuing from the vent of a rectangular plenum, for example, would not be in a radially inwardly converging, annular pattern. Nonetheless, in certain instances such a configuration could be used and would still provide significant advantages in terms of using less assist gas then prior art assemblies.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A gas assist flare tip apparatus for enhancing smokeless combustion of a waste gas issuing from a flare stack riser through an open end comprising:

a first shroud adapted to be positioned on said flare stack, said first shroud including an outer annular portion and an inner tubular portion having a diameter sized to allow said tubular portion to be slidable over said flare stack riser;

an annular plenum partially formed by said tubular portion and said outer portion, said plenum having a first annular vent proximate said open end; and at least one air jet eductor having a discharge outlet opening into said plenum, said jet eductor comprising a venturi assembly having a body forming a motive nozzle, said body including a motive gas inlet, a suction inlet, and a venturi diffuser tube, said motive nozzle having a nozzle outlet opening into said diffuser tube, said diffuser tube having a discharge orifice forming said discharge orifice.

2. The apparatus of claim 1 wherein said outer portion of said first shroud includes an upper, frustoconical portion having a smaller end adjacent said open end of said flare stack riser, said annular vent being formed between said tubular portion and said smaller end of said frustoconical portion proximate said open end.

3. The apparatus of claim 1 wherein there are a plurality of said air jet eductors.

4. The apparatus of claim 3 wherein there are four eductors.

5. The apparatus of claim 3 wherein there are six eductors.

6. The apparatus of claim 1 further including a source of motive gas connected to said eductor.

7. The apparatus of claim 2 wherein said shroud further comprises an annular plate disposed between said tubular portion and said frustoconical portion.

8. The apparatus of claim 7 wherein said eductor discharge outlet is formed in said annular plate.

9. The apparatus of claim 1 wherein there is an internally threaded socket open on both ends connected to said tubular portion for receipt of a set screw to engage said riser.

10. The apparatus of claim 1 wherein said tubular portion has an upper end proximal the open end of said flare stack riser and there is a radially inwardly extending annular lip for engaging the top of said riser when said apparatus is positioned on said riser.

11. The apparatus of claim 2 wherein there is a second shroud connected to and in surrounding relationship to said first shroud, said first and second shrouds at least partially cooperating to form a second plenum.

12. The apparatus of claim 11 wherein said second plenum has a second annular vent adjacent said first annular vent.

13. The apparatus of claim 11 wherein said second plenum is connected to a gas feed line.

14. A method of enhancing smokeless combustion of a waste gas issuing from a flare stack riser through an open end comprising:

providing an annular plenum having a constricted annular vent in surrounding relationship and proximate said open end of said riser;

introducing a pressurized gas having a first flow velocity into said plenum; and forcing said pressurized gas out said annular vent creating an assist gas flow in an annular pattern around said open end at a second, higher flow velocity, said assist gas flow being directed in a radially inwardly converging pattern.

15. The method of claim 14 comprising introducing said gas into said plenum via an air jet eductor.

16. The method of claim 15 wherein said air jet eductor comprises a venturi assembly.

17. The method of claim 16 further comprising providing a motive gas source for introducing into the inlet of said venturi assembly.

18. The method of claim 17 comprising using said motive gas to aspirate air into said venturi assembly.

19. A method of enhancing smokeless combustion of high pressure and low pressure waste gas streams comprising:

providing a flare stack riser having an open end;

flowing a high pressure waste gas through said riser;

providing a first annular plenum having a constricted annular vent in surrounding relationship to and proximate said open end of said riser;

providing a second annular plenum in surrounding relationship to said first plenum and having a second annular vent in surrounding relationship to and proximate said constricted annular vent;

flowing a low pressure waste gas into said second plenum;

introducing a pressurized gas having a first flow velocity into said first plenum; and forcing said pressurized gas out said first annular vent creating an assist gas flow in an annular pattern around said open end and a second higher flow velocity, said assist gas being directed in a radially inwardly converging pattern.

20. The method of claim 19 comprising introducing said pressurized gas into said first plenum via an air jet eductor.

21. The method of claim 20 wherein said air jet eductor comprises a venturi assembly.

22. The method of claim 21 further comprising providing a motive gas source for introducing into the inlet of said venturi assembly.

23. The method of claim 22 comprising using said motive gas to aspirate air into said venturi assembly.

24. A gas assist flare tip apparatus for enhancing smokeless combustion of a waste gas issuing from a flare stack riser having an upper end surface comprising:

a first shroud adapted to be positioned on said flare stack, said first shroud including an outer annular portion and an inner tubular portion having a diameter sized to allow said tubular portion to be slidable over said flare stack riser, said tubular portion having an upper end proximal the upper end surface of said flare stack riser and a radially inwardly extending lip for engaging the upper end surface of said riser when said apparatus is positioned on said riser;

an annular plenum partially formed by said tubular portion and said outer portion, said plenum having a first annular vent proximate said open end; and at least one air jet eductor having a discharge outlet opening into said plenum.

25. The apparatus of claim 15, wherein there is an internally threaded socket open on both ends connected to said tubular portion for receipt of a threaded member to engage said riser.

* * * * *